US009093020B2

(12) United States Patent
Baek et al.

(10) Patent No.: US 9,093,020 B2
(45) Date of Patent: Jul. 28, 2015

(54) MODE CONVERSION METHOD, AND DISPLAY DRIVING INTEGRATED CIRCUIT AND IMAGE PROCESSING SYSTEM USING THE METHOD

(75) Inventors: Dong-hoon Baek, Seoul (KR); Jae-youl Lee, Yongin-si (KR); Han-su Pae, Hwaseong-si (KR); Young-min Choi, Suwon-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 814 days.

(21) Appl. No.: 13/117,744

(22) Filed: May 27, 2011

(65) Prior Publication Data

US 2011/0292024 A1 Dec. 1, 2011

(30) Foreign Application Priority Data

Jun. 1, 2010 (KR) ..... 10-2010-0051964

(51) Int. Cl.
*G09G 3/20* (2006.01)
*G09G 5/00* (2006.01)

(52) U.S. Cl.
CPC ..... *G09G 3/2096* (2013.01); *G09G 5/008* (2013.01); *G09G 2330/021* (2013.01)

(58) Field of Classification Search
CPC ..... G09G 2330/021; G09G 3/3614; G09G 3/3648; G09G 2310/08; G09G 2370/08
See application file for complete search history.

(56) References Cited

U.S. PATENT DOCUMENTS 7,119,782 B2 10/2006 Sunohara et al.
7,773,083 B2 8/2010 Minami
7,999,781 B2 8/2011 Inada
8,076,954 B2 12/2011 Murayama et al.
8,284,179 B2 10/2012 Chen
8,664,972 B2 3/2014 Murayama et al.
2006/0208997 A1 9/2006 Sunohara et al.
2007/0262976 A1 11/2007 Matsuda et al.
2009/0128540 A1 * 5/2009 Hsu ..... 345/213

(Continued)

FOREIGN PATENT DOCUMENTS

CN 1 453 760 A 11/2003
CN 1 674 082 A 9/2005
CN 1 841 483 A 10/2006

(Continued)

OTHER PUBLICATIONS

Chinese Office Action and English Translation mailed on Feb. 12, 2015.

*Primary Examiner* — Michael Faragalla
(74) *Attorney, Agent, or Firm* — Harness, Dickey & Pierce

(57) ABSTRACT

According to an example embodiment, a display driving integrated circuit (IC) includes a timing controller and a plurality of source drivers. The timing controller is configured to output a plurality of signals to the plurality of source drivers, and at least one of the timing controller and the plurality of source drivers operates in a power down mode in at least one of an initializing period, a data transmission period, and a vertical blank period. According to an example embodiment, a mode conversion method used in a display driving IC includes switching between a normal mode to a power down mode in response to a standby control signal. The power down mode is implemented on at least one of a timing controller and a plurality of source drivers included in the display driving IC in at least one of an initializing period, a data transmission period, and a vertical blank period.

14 Claims, 7 Drawing Sheets

(56) References Cited

U.S. PATENT DOCUMENTS

| | | | | |
|---|---|---|---|---|
| 2009/0201274 | A1 | 8/2009 | Kuwabara et al. | |
| 2009/0267974 | A1 * | 10/2009 | Kitagawa et al. | 345/691 |

FOREIGN PATENT DOCUMENTS

| | | | |
|---|---|---|---|
| CN | 101 004 499 | A | 7/2007 |
| CN | 101 031 953 | A | 9/2007 |
| CN | 101 040 440 | A | 9/2007 |
| CN | 101 499 244 | A | 8/2009 |
| CN | 101 515 443 | A | 8/2009 |
| CN | 101 529 394 | A | 9/2009 |
| JP | 2006018149 | A | 1/2006 |
| JP | 2008008928 | A | 1/2008 |
| JP | 2008249811 | A | 10/2008 |

* cited by examiner

MODE CONVERSION METHOD, AND DISPLAY DRIVING INTEGRATED CIRCUIT AND IMAGE PROCESSING SYSTEM USING THE METHOD

CROSS-REFERENCE TO RELATED APPLICATIONS

This application claims priority under 35 U.S.C. §119 to Korean Patent Application No. 10-2010-0051964, filed on Jun. 1, 2010, in the Korean Intellectual Property Office, the disclosure of which is incorporated herein in its entirety by reference.

BACKGROUND

Example embodiments of the inventive concepts relate to a mode conversion method, and a display driving integrated circuit (IC) and an image processing system using the method.

A display driving system includes a timing controller, a display driving IC, and a panel. The display driving IC includes a source driver and a gate driver used to drive picture elements of a panel that reproduces an image signal, and may also include a timing controller. A timing controller converts input image information into a signal for a display driving IC and transmits the same to the display driving IC.

SUMMARY

According to example embodiments of the inventive concepts, a display driving integrated circuit (IC), includes a plurality of source drivers, and a timing controller. The timing controller is configured to output a plurality of signals to the plurality of source drivers. At least one of the timing controller and the plurality of source drivers is configured to operate in a power down mode in at least one of an initializing period, a data transmission period, and a vertical blank period.

According to example embodiments of the inventive concepts, a period of the power down mode occurs during a portion of the at least one of the initializing period, the data transmission period, and the vertical blank period.

According to example embodiments of the inventive concepts, the power down mode in the data transmission period is activated in a portion of a horizontal blank period included in the data transmission period.

According to example embodiments of the inventive concepts, in the power down mode, the timing controller is configured to output at least one of a constant DC voltage and a high impedance setting signal to the plurality of source drivers. An internal circuit of the timing controller is configured such that a bias current flowing through a clock signal generator included in the timing controller is reduced. An internal circuit of the plurality of source drivers is configured such that an internal bias current of the internal circuit is reduced.

According to example embodiments of the inventive concepts, in the power down mode, the plurality of source drivers are configured to have their internal on die termination (ODT) resistance values modified.

According to example embodiments of the inventive concepts, the timing controller is configured to generate a standby control signal to activate the power down mode.

According to example embodiments of the inventive concepts, the timing controller is further configured to generate the standby control signal based on at least one of an external signal and a status of an internal logic circuit.

According to example embodiments of the inventive concepts, the timing controller is configured to transmit the standby control signal to each of the plurality of source drivers in a point-to-point manner or in a multi-drop manner.

According to example embodiments of the inventive concepts, the timing controller is configured to transmit a data packet including a plurality of fields to the source drivers in the data transmission period. At least one of the plurality of fields includes the standby control signal.

According to example embodiments of the inventive concepts, the timing controller is configured to transition from the power down mode to a normal mode when the activated standby control signal is deactivated.

According to example embodiments of the inventive concepts, the timing controller includes a first clock signal generator and the timing controller is configured to adjust a bias current flowing through the first clock signal generator to a normal value in the normal mode. At least one of the plurality of source drivers includes a second clock signal generator and the at least one of the plurality of source drivers is configured to adjust a bias current flowing through the second clock signal generator to a normal value in the normal mode.

According to example embodiments of the inventive concepts, the display driving IC is of a clock embedded type. The timing controller includes a clock signal generator and is configured to output a training pattern in the normal mode. The plurality of source drivers are configured, in the normal mode, to determine a point at which the clock signal generator starts clock training according to the training patterns. The point is determined as a starting point of the normal mode.

According to example embodiments of the inventive concepts, a mode conversion method used in a display driving IC, includes switching at least one of a timing controller and a plurality of source drivers between a normal mode and a power down mode in response to a standby control signal during at least one of an initializing period, a data transmission period, and a vertical blank period.

According to example embodiments of the inventive concepts, the switching switches from the normal mode to the power down mode by, generating the standby control signal from the timing controller; and reducing power supplied to at least one of the timing controller and the source drivers in response to the standby control signal.

According to example embodiments of the inventive concepts, the reducing includes outputting, by the timing controller, a constant DC voltage or a high impedance setting signal to the plurality of source drivers, controlling an internal circuit of the timing controller such that a bias current flowing through a clock signal generator included in the timing controller is reduced, and setting an internal circuit in the source drivers such that an internal bias current is reduced.

According to example embodiments of the inventive concepts, the generating generates the standby control signal based on at least one of a signal externally applied to the timing controller and a status of an internal logic circuit.

According to example embodiments of the inventive concepts, the method further includes transmitting a data packet including a plurality of fields from the timing controller to the plurality of source drivers in the data transmission period. At least one of the plurality of fields includes the standby control signal.

According to example embodiments of the inventive concepts, an image data processing system, includes a display panel configured to reproduce an image signal; a plurality of source drivers configured to drive the display panel; and a timing controller configured to control an operation of the plurality of source drivers, at least one of the timing controller and the plurality of source drivers operating in a power down mode wherein power consumption is reduced in at least one of an initializing period, a data transmission period, and a vertical blank period.

According to example embodiments of the inventive concepts, a display driving integrated circuit (IC), includes a plurality of source drivers; and at least one timing controller configured to output a plurality of display data signals to drive the plurality of source drivers. The plurality of display data signals include packets of image data and control data. At least one of the at least one timing controller and the plurality of source drivers are configured to operate in a power down mode.

According to example embodiments of the inventive concepts, at least one source driver of the plurality of source drivers includes a clock recovery unit having at least one of a delay locked loop circuit and a phase locked loop circuit, a deserializer configured to convert serially received image data into parallel data in response to the multi-phase clock signal and to transfer the parallel data, a data latch unit configured to store the parallel data, and a data transformation unit configured to receive data from the data latch unit and generate an analog image signal corresponding to data received in digital format from the data latch unit, and to input the analog image signal to a display panel. The clock recovery unit is configured to generate a recovery clock signal from the received display data signal, generate a multi-phase clock signal based on the generated recovery clock signal, and transmit the generated multi-phase clock signal and an image data included in the display data signal.

According to example embodiments of the inventive concepts, the at least one timing controller is configured to generate a standby control signal to activate the power down mode.

According to example embodiments of the inventive concepts, the at least one timing controller is configured to transmit a data packet including a plurality of fields to the plurality of source drivers in the data transmission period, and include the standby control signal in at least one of the plurality of fields.

According to example embodiments of the inventive concepts, the at least one timing controller is configured to transition from the power down mode to a normal mode when the activated standby control signal is deactivated.

According to example embodiments of the inventive concepts, the at least one timing controller includes a first clock signal generator and the at least one timing controller is configured to adjust a bias current flowing through the first clock signal generator to a normal value in the normal mode. At least one of the plurality of source drivers includes a second clock signal generator and the at least one of the plurality of source drivers is configured to adjust a bias current flowing through the second clock signal generator to a normal value in the normal mode.

According to example embodiments of the inventive concepts, the display driving IC is of a clock embedded type, the at least one timing controller includes a clock signal generator and is configured to output a training pattern in the normal mode, and the plurality of source drivers are configured, in the normal mode, to determine a point at which the clock signal generator starts clock training according to the training pattern, wherein the point is determined as a starting point of the normal mode.

BRIEF DESCRIPTION OF THE DRAWINGS

The above and other features and advantages will become more apparent by describing in detail example embodiments with reference to the attached drawings. The accompanying drawings are intended to depict example embodiments and should not be interpreted to limit the intended scope of the claims. The accompanying drawings are not to be considered as drawn to scale unless explicitly noted.

DETAILED DESCRIPTION OF THE EXAMPLE EMBODIMENTS

Figure 1:
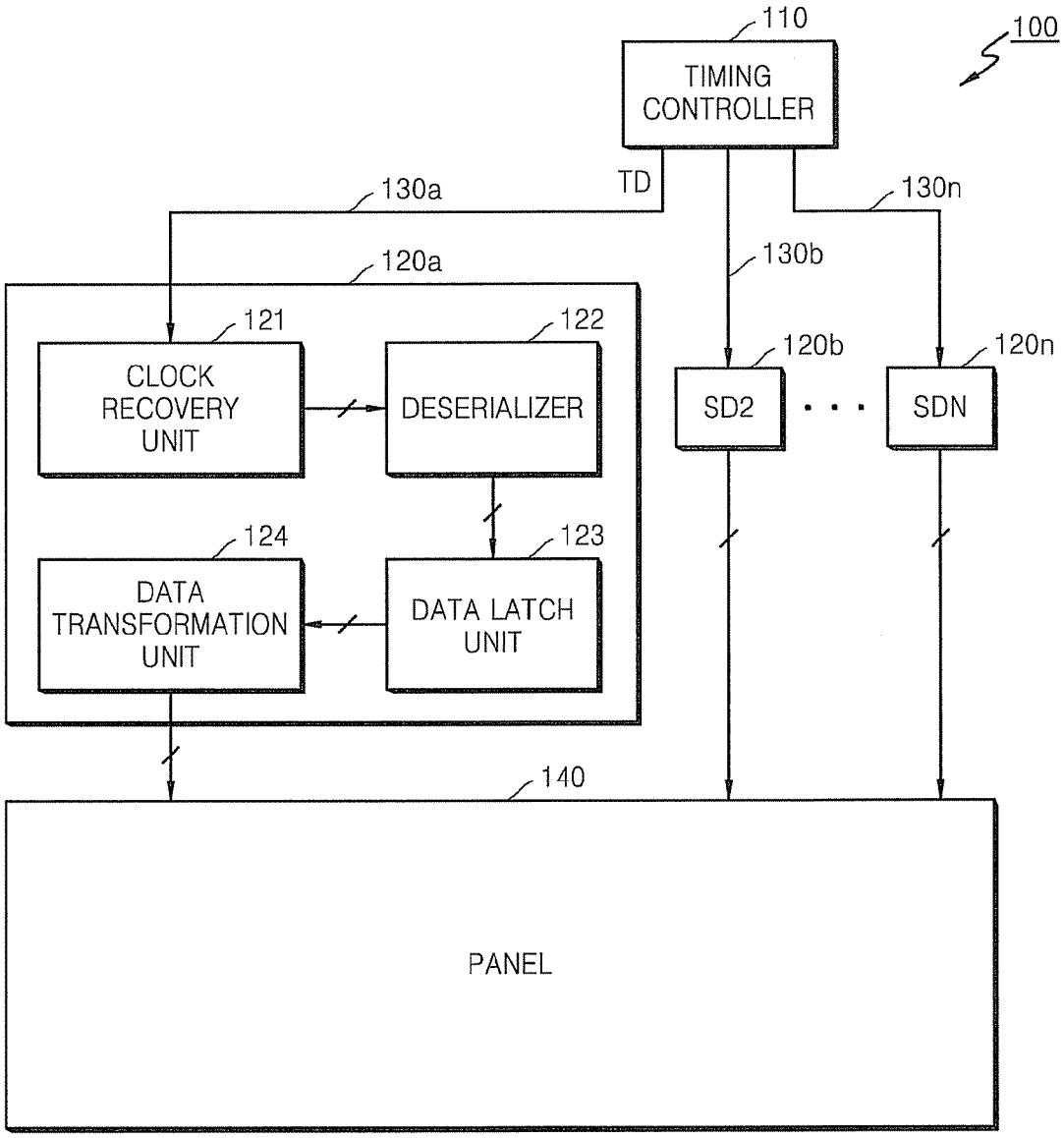
FIG. 1 illustrates a portion of a display driving system according to an example embodiment of the inventive concepts.

Detailed example embodiments are disclosed herein. However, specific structural and functional details disclosed herein are merely representative for purposes of describing example embodiments. Example embodiments may, however, be embodied in many alternate forms and should not be construed as limited to only the embodiments set forth herein.

Accordingly, while example embodiments are capable of various modifications and alternative forms, embodiments thereof are shown by way of example in the drawings and will herein be described in detail. It should be understood, however, that there is no intent to limit example embodiments to the particular forms disclosed, but to the contrary, example embodiments are to cover all modifications, equivalents, and alternatives falling within the scope of example embodiments. Like numbers refer to like elements throughout the description of the figures.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of example embodiments. As used herein, the teen "and/or" includes any and all combinations of one or more of the associated listed items.

It will be understood that when an element is referred to as being "connected" or "coupled" to another element, it may be directly connected or coupled to the other element or intervening elements may be present. In contrast, when an element is referred to as being "directly connected" or "directly coupled" to another element, there are no intervening elements present. Other words used to describe the relationship between elements should be interpreted in a like fashion (e.g., "between" versus "directly between", "adjacent" versus "directly adjacent", etc.).

The terminology used herein is for the purpose of describing particular embodiments only and is not intended to be limiting of example embodiments. As used herein, the singular forms "a", "an" and "the" are intended to include the plural forms as well, unless the context clearly indicates otherwise. It will be further understood that the terms "comprises", "comprising,", "includes" and/or "including", when used herein, specify the presence of stated features, integers, steps, operations, elements, and/or components, but do not preclude the presence or addition of one or more other features, integers, steps, operations, elements, components, and/or groups thereof.

It should also be noted that in some alternative implementations, the functions/acts noted may occur out of the order noted in the figures. For example, two figures shown in succession may in fact be executed substantially concurrently or may sometimes be executed in the reverse order, depending upon the functionality/acts involved.

According to an example embodiment of the inventive concepts, maximum consumption power of a display driving system is reduced by setting devices of the display driving system to operate in a power down mode in at least one of an initialization period, a data transmission period, and a vertical blank period (VBP). The initialization period, the data transmission period, and the vertical blank period may all occur in a power down mode, or a portion of the initialization period, a portion of a horizontal blank period included in the data transmission period, and a portion of the vertical blank period may occur in a power down mode. The display driving system operates in an initial training mode in the initialization period, and in a display data mode in the data transmission period, and in a vertical training mode in the vertical blank period.

FIG. 1 illustrates a portion of a display driving system 100 according to an example embodiment of the inventive concepts.

Figure 2:
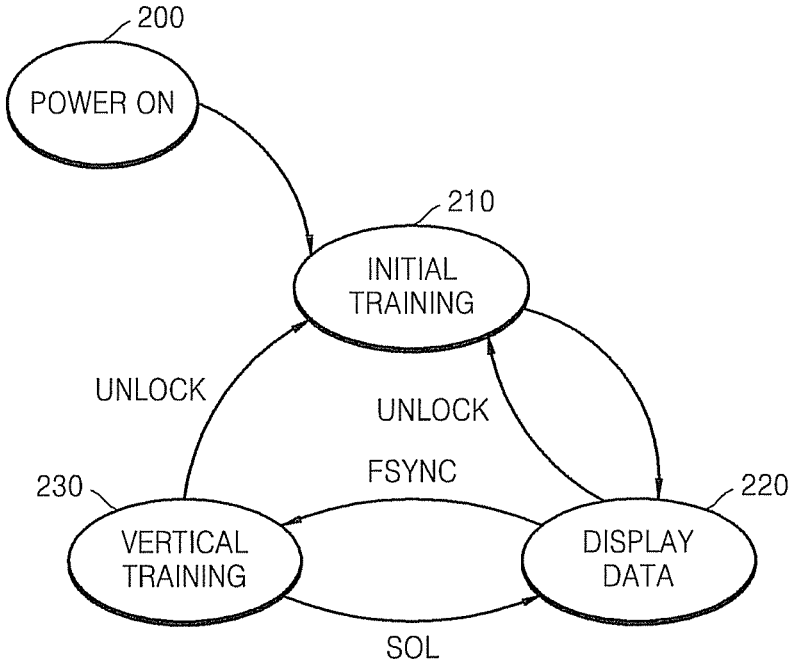
FIG. 2 is a status diagram illustrating an operation of a display driving system according to an example embodiment of the inventive concepts.

FIG. 2 is a status diagram illustrating an operation of the display driving system 100 according to an example embodiment of the inventive concepts.

Hereinafter, an operation of the display driving system 100 of FIG. 1 will be described with reference to the status diagram of FIG. 2.

Referring to FIG. 1, the display driving system 100 includes a timing controller 110, a plurality of source drivers 120*a*, 120*b*, . . . , 120*n* (where n is a natural number), and a panel 140. Display data TD including image data output from the timing controller 110, control data, and a clock signal passes through a plurality of signal lines 130*a*, 130*b*, . . . , 130*n* to the source drivers 120*a*, 120*b*, . . . , 120*n*. Each of the source drivers 120*a*, 120*b*, . . . , 120*n* include a clock recovery unit 121, a deserializer 122, a data latch unit 123, and a data transformation unit 124. The panel 140 reproduces an image corresponding to the image data. A commonality between the clock recovery unit 121 and a clock generator is that both generate a clock signal, and thus the clock recovery unit 121 may also be referred to as a clock generator in the following description.

When power is initially applied in a power on mode 200 (FIG. 2), the timing controller 110 operates in an initial training mode 210. In the initial training mode 210, the timing controller 110 transmits clock training signals that are used to lock the clock recovery unit 121 of the source drivers 120*a*, 120*b*, . . . , 120*n*, to the source drivers 120*a*, 120*b*, . . . , 120*n*. The clock recovery unit 121 included in the source drivers 120*a*, 120*b*, . . . , 120*n* includes a delay locked loop circuit or a phase locked loop, and recovers a clock signal received from the timing controller 110.

When the plurality of the source drivers 120*a*, 120*b*, . . . , 120*n* are stabilized through the initial training mode 210, the timing controller 110 operates in a display data mode 220. The timing controller 110 transmits a data packet including a start of line SOL to the source drivers 120*a*, 120*b*, . . . , 120*n* to inform the source drivers 120*a*, 120*b*, . . . , 120*n* of a start of the display data mode 220, and display data is included in the data packet. After transmitting display data of one screen, for example, one frame, to the source drivers 120*a*, 120*b*, . . . , 120*n*, the display data mode 220 ends, and the source drivers 120*a*, 120*b*, . . . , 120*n* may be informed about an end of the display data mode 220 by including a frame synchronizing signal FSYNC included in the data packet.

After the display data corresponding to one frame is transmitted to the source drivers 120*a*, 120*b*, . . . , 120*n*, a vertical training mode 230 is performed.

Hereinafter, the clock recovery unit 121, the deserializer 122, the data latch unit 123, and the data transformation unit 124 included in the source drivers 120*a*, 120*b*, . . . , 120*n* will be described.

The clock recovery unit 121 may be stabilized in a locked state in the initialization period by using a clock training signal. The clock recovery unit 121 generates a recovery clock signal from the display data TD in a data transmission period, and generates a multi-phase clock signal based on the generated recovery clock signal. The generated multi-phase clock signal and image data included in the display data TD are transmitted to the deserializer 122. The deserializer 122 converts the image data that is serially input in response to the multi-phase clock signal, to parallel data and transfers the parallel data to the data latch unit 123. The data latch unit 123 may be implemented in a variety of configurations and methods, including, but not limited to, for example, a shift register. The data transformation unit 124 generates an analog image signal corresponding to the image data in a digital format stored in the data latch unit 123 and transfers the analog image signal to the display panel 140.

Figure 3:
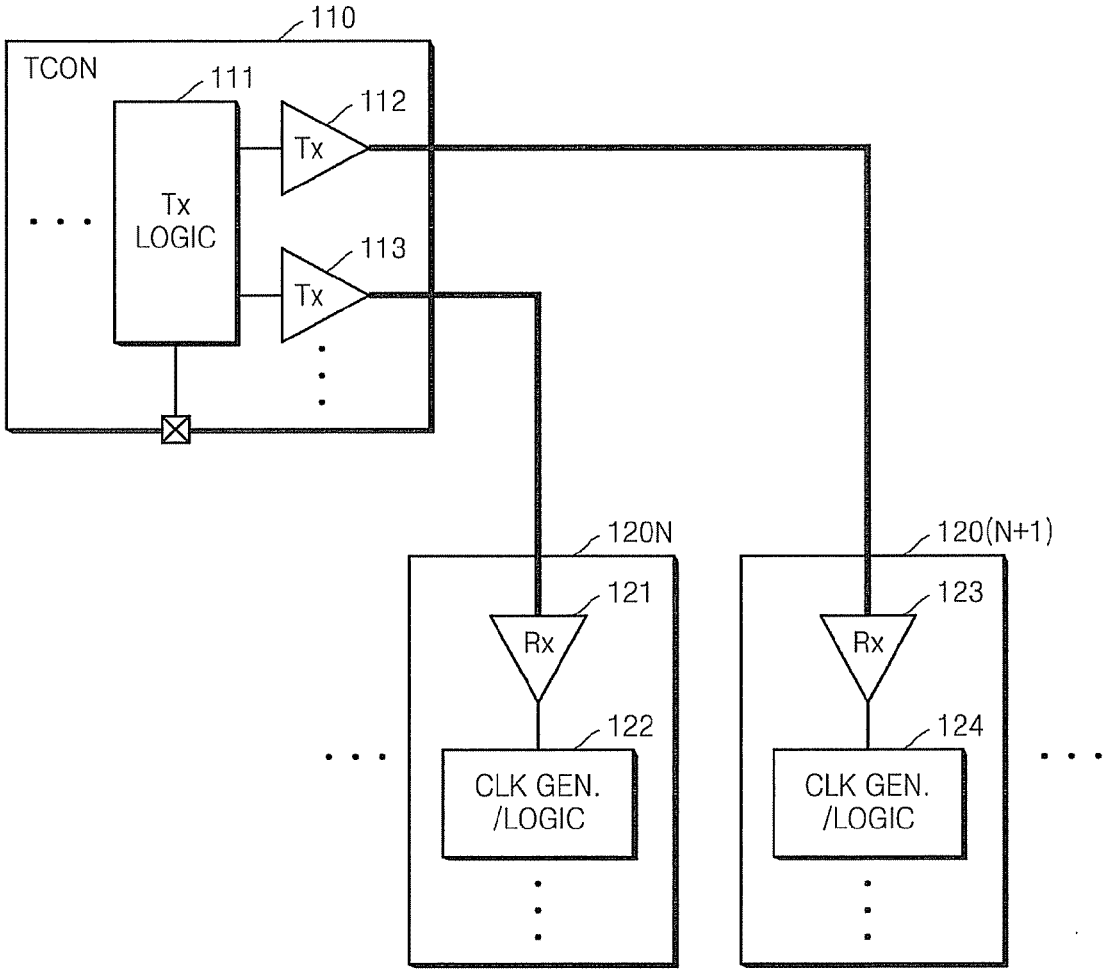
FIG. 3 is a schematic view illustrating a display driving system according to an example embodiment of the inventive concepts.

FIG. 3 is a schematic view illustrating a display driving system 100 according to an example embodiment of the inventive concepts.

Referring to FIG. 3, the display driving system 100 includes a timing controller 110 and a plurality of source drivers 120N, 120(N+1) . . . (where N is a natural number). The timing controller 110 includes a logic circuit 111, a plurality of output devices 112 and 113 that transfer signals output from the logic circuit 111 to the plurality of source drivers 120N, 120(N+1), . . . in a point-to-point manner. Signals output from the timing controller 110 pass through receivers 121 and 123 included in each of the plurality of source drivers 120N, 120(N+1) . . . and are transferred to clock generation and logic circuits 122 and 124.

The timing controller 110 and the source drivers 120N, 120(N+1) . . . illustrated in FIG. 3 operate in a power down mode where consumption power is minimized, in at least one of an initialization period, a data transmission period, and a VBP.

Figure 4:
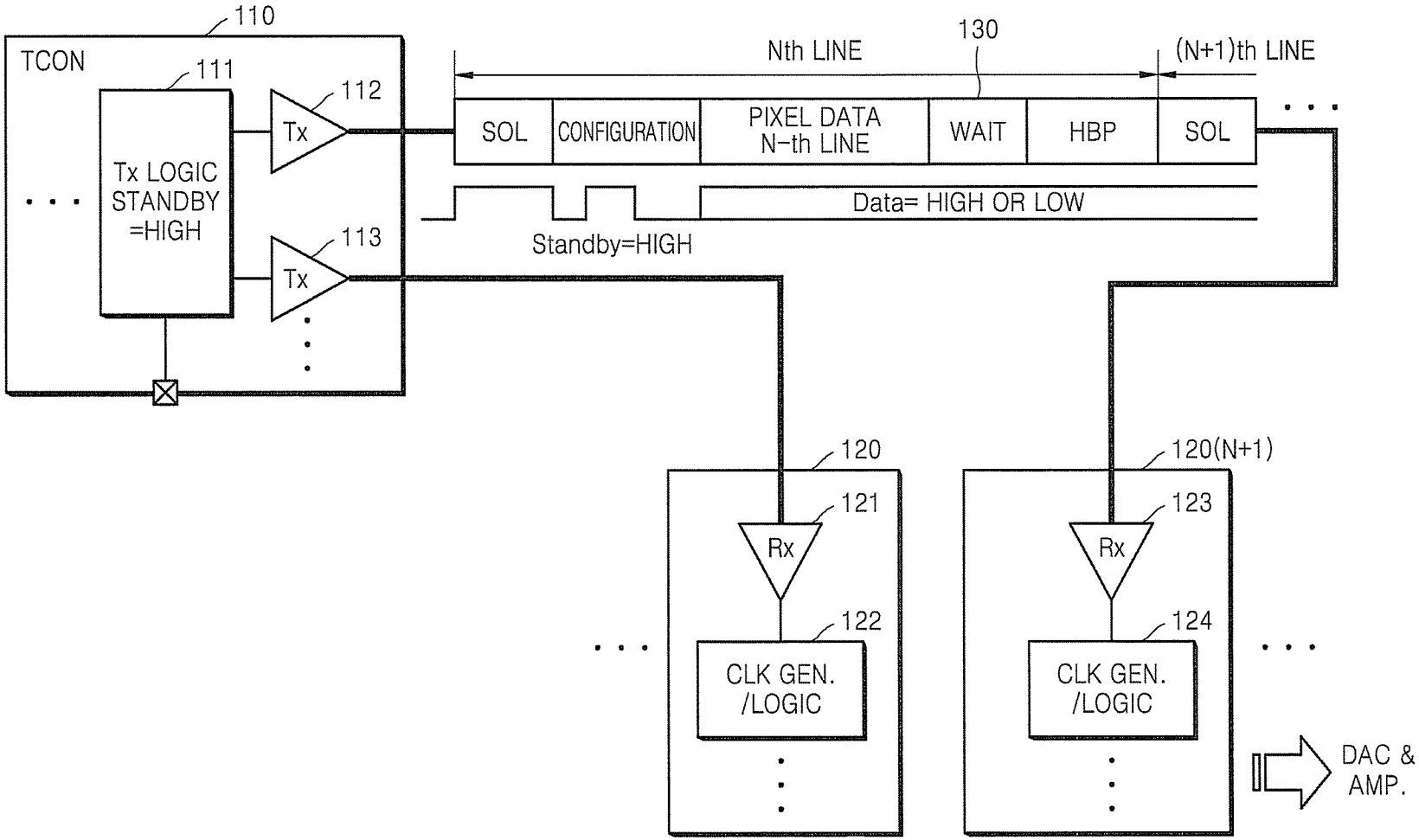
FIG. 4 illustrates a display data system entering a power down mode according to an example embodiment of the inventive concepts.

FIG. 4 illustrates a display data system entering a power down mode according to an example embodiment of the inventive concepts.

Referring to FIG. 4, in order to enter a power down mode, a standby control signal STANDBY is activated as logic high HIGH from a logic circuit 111 of a timing controller 110. The standby control signal STANDBY may be included in a field CONFIGURATION of a data packet 130. Here, a signal output from the output devices 112 and 113 of the liming controller 110 is fixed as either logic high HIGH or logic low LOW. Referring to FIG. 4, the standby control signal STANDBY is included in the data packet 130 and is transferred to a plurality of source drivers 120N, 120(N+1), . . . , but the standby control signal STANDBY may also be separately transferred via another signal line.

The plurality of source drivers 120N, 120(N+1), . . . each may enter a power down mode in various ways, for example, by detecting a standby control signal STANDBY included in the transmitted data packet 130, by checking that image data included in the data packet 130 is fixed as logic high or logic low, or by detecting a standby control signal STANDBY transferred via another signal line. In addition, a power down mode sometimes may be entered by checking a register value allocated to direct a power down mode or with a format of an internal clock signal generated from a clock generator.

As disclosed above, the standby control signal STANDBY in a logic high HIGH state is activated, but a standby control signal in a logic low LOW state may also be used instead.

Figure 5:
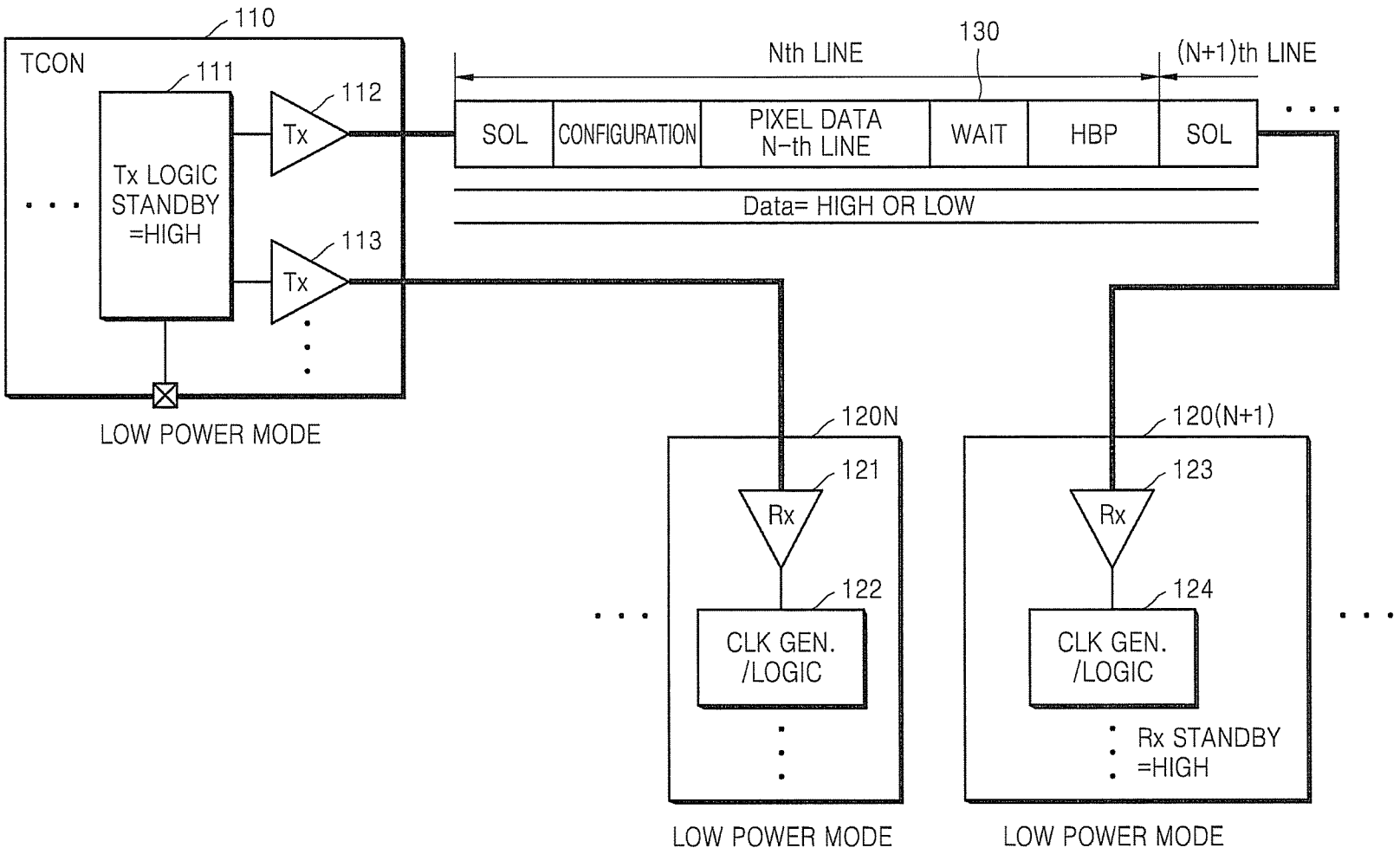
FIG. 5 illustrates a display data system in a power down mode according to an example embodiment of the inventive concepts.

FIG. 5 illustrates a configuration of a display data system in a power down mode according to an example embodiment of the inventive concepts.

Referring to FIG. 5, in a power down mode, all of the timing controller 110 and the plurality of source drivers 120N and 120(N+1) operate in a power down mode in which power consumption is minimized.

For the timing controller 110 to operate in a power down mode, internal circuits may be modified such that power consumption of devices which consume a relatively large amount of power, such as a clock generator (not shown), may be minimized as much as possible. Modifying internal circuits to consume as little power as possible is relatively well known to one of ordinary skill in the art, and thus a detailed description thereof is omitted for the sake of brevity. For example, the internal circuits may be modified such that a bias current of a circuit consuming a relatively high amount of current is minimized as much as possible. For example, in a complementary metal-oxide-semiconductor (CMOS) circuit, power is consumed when a logic value of a signal changes. To minimize power consumption in a power down mode, a signal transferred to the output devices 112 and 113 from the transfer logic circuit 111 may be fixed as logic high or logic low in order to avoid signal transitions and minimize the power consumption. Referring to FIG. 5, a data packet 130 output from the timing controller 110 includes a fixed logic value of logic high or logic low. According to an example embodiment, the output devices 112 and 113 may be put in a high impedance state upon receipt of a high impedance setting signal from the timing controller 110.

In the power down mode, the plurality of source drivers 120N, 120(N+1), . . . are also adjusted so as to stop operations of internal circuits or to minimize current consumption, and this may be performed in a similar manner as the timing controller 110. Internal on die termination (ODT) resistance exists in the receivers 121 and 123, and power consumption may be minimized (for example, increased or decreased) by modifying a resistance value of the ODT resistance in the power down mode.

Figure 6:
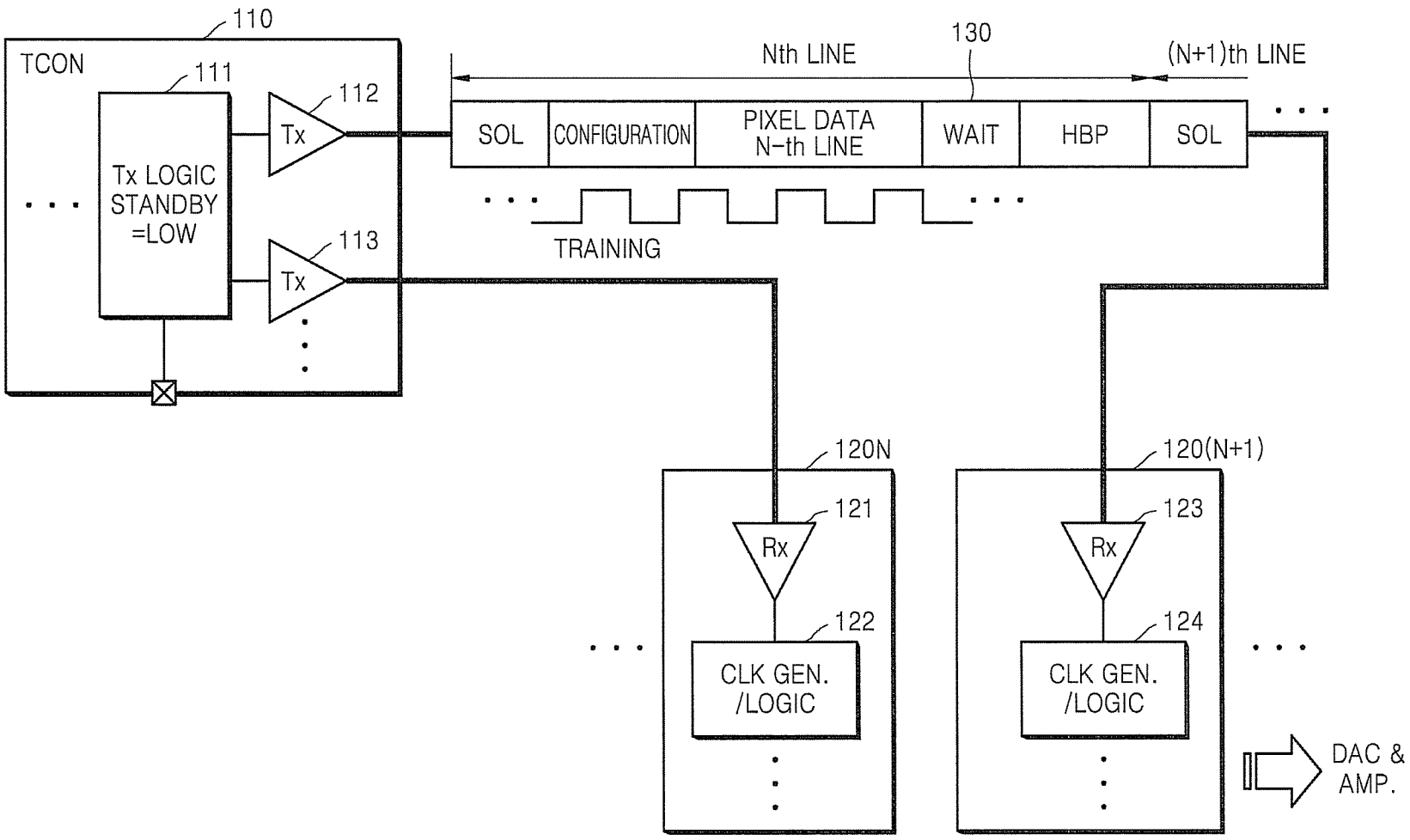
FIG. 6 illustrates a display data system in a normal mode according to an example embodiment of the inventive concepts.

FIG. 6 illustrates a configuration of a display data system in a normal mode according to an example embodiment of the inventive concepts.

Referring to FIG. 6, in order to transition from the power down mode to a normal mode, the standby control signal STANDBY is activated as logic low LOW. Here, the clock generator (not shown) of the timing controller 110, and the transfer logic circuit 111 operate normally, and thus normal data is included in the data packet 130. In order that a plurality of source drivers 120N, 120(N+1), . . . also operate in a normal mode, a bias current flows normally through the internal circuits, or a modified ODT resistance value is modified to a normal value.

If the display data system is a clock embedded type in which a clock signal is included in a data packet, the timing controller 110 transmits a timing pattern in order to instruct the plurality of source drivers 120N, 120(N+1), . . . to operate in a normal mode. The plurality of source drivers 120N, 120(N+1), . . . determine a point at which an internal clock generator (not shown) starts clock training according to the timing pattern (i.e., training pattern), as a starting point of a normal mode.

Figure 7:
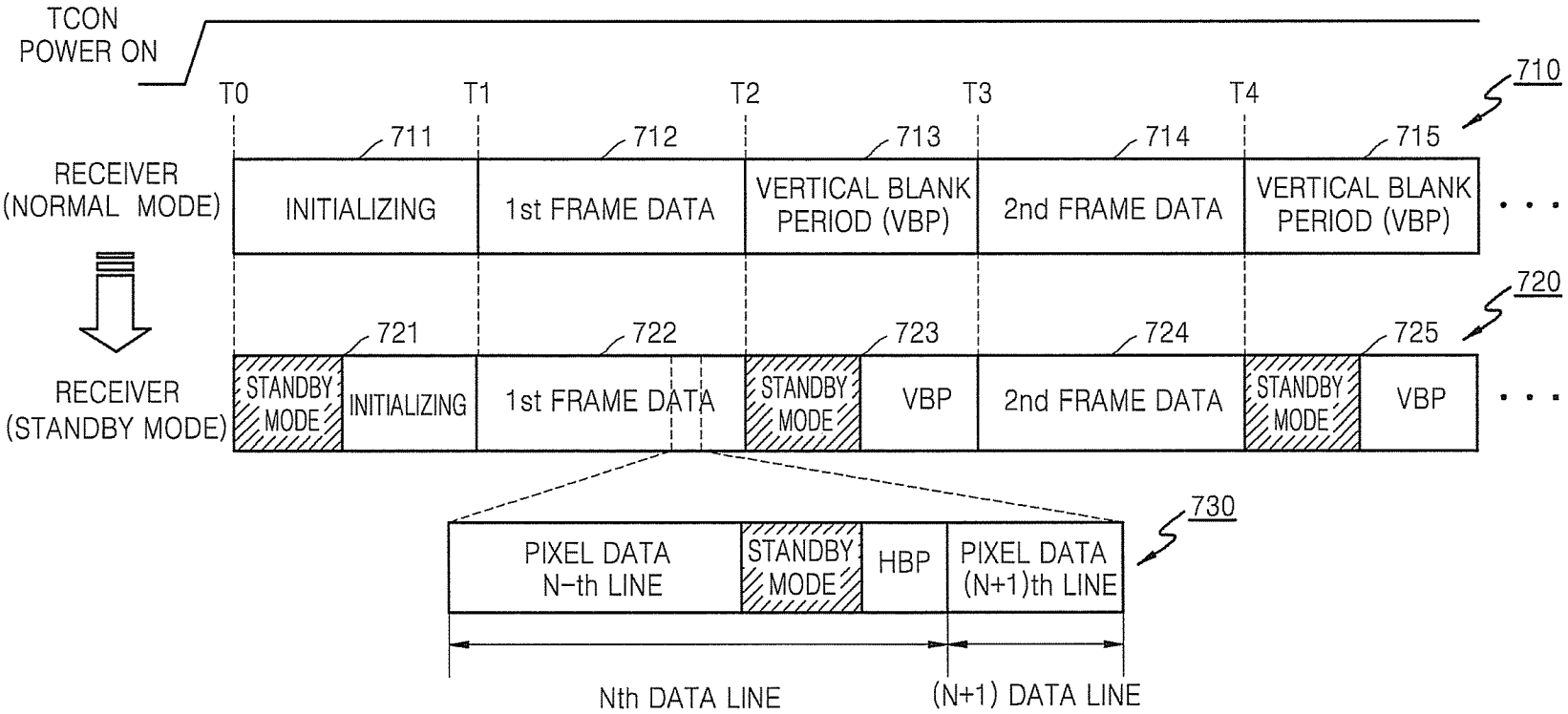
FIG. 7 illustrates a relationship between a timing control signal TCON and a data packet.

FIG. 7 illustrates a relationship between a timing control signal TCON and a data packet.

Referring to FIG. 7, in a normal case illustrated at 710, when a timing control signal TCON is activated, first frame data 712 and a VBP 713 are transferred from a timing controller to a source driver after initializing 711, and then second frame data 714 and a VBP 715 are further transferred as one unit.

According to example embodiments of the inventive concepts, a power down mode is introduced in periods other than necessary minimum periods in the initializing period 711, the data transmission periods 712 and 714, and the VBPs 713 and 715.

A data packet 720 according to an example embodiment of the inventive concepts has the same format as the conventional data packet 710 except that a power down mode, which is here denoted by STANDBY MODE, (three different words are used for power down mode . . . ) is performed in at least a portion of each of an initializing period 721, a data transmission period 722, and a VBP 723.

An initializing period refers to a time needed for a timing controller to be stabilized when power is initially supplied to the timing controller; however, the portion of the initializing period greater than a minimum sufficient initializing period occurs in a power down mode in order to reduce power consumption.

In a data transmission period, a plurality of pieces of line data of one frame are included in a data packet, and there is a horizontal blank period (HBP) between the line data. The HBP is a time period for providing sufficient time for image data transferred in units of lines to be processed in an internal circuit of a source driver and the HBP is sufficiently long to stabilize the system. According to an example embodiment of the inventive concepts, a power down mode is applied to a portion of the HBP that exceeds a minimum required time period of the HBP for stable operation of the system. A plurality of line data are included in one frame 722 as illustrated in example 730, and a power down mode is performed every time the plurality of line data are transferred.

A VBP is present in order to distinguish one frame from another, and according to an example embodiment of the inventive concepts, a power down mode is applied to a portion of the VBP that exceeds a minimum required time period of the VBP for normal operation.

As described above, in the display driving system, power consumption of devices such as a timing controller and a source driver is minimized during a time period except a time needed to perform functions, of an initializing period, a HBP, and a VBP. Accordingly, the power consumption of the whole system is minimized.

Example embodiments having thus been described, it will be obvious that the same may be varied in many ways. Such variations are not to be regarded as a departure from the intended spirit and scope of example embodiments, and all such modifications as would be obvious to one skilled in the art are intended to be included within the scope of the following claims.

What is claimed is:

1. A display driving integrated circuit (IC), comprising:

a plurality of source drivers; and a timing controller configured to output a plurality of signals to the plurality of source drivers, at least one of the timing controller and the plurality of source drivers configured to operate in a power down mode in at least one of an initializing period, a data transmission period, and a vertical blank period, wherein in the power down mode, the timing controller is configured to output at least one of a constant DC voltage and a high impedance setting signal to the plurality of source drivers, an internal circuit of the timing controller is configured such that a bias current flowing through a clock signal generator included in the timing controller is reduced, an internal circuit of the plurality of source drivers is configured such that an internal bias current of the internal circuit is reduced, and the plurality of source drivers are configured to have their internal on die termination (ODT) resistance values modified.

2. The display driving IC of claim 1, wherein a period of the power down mode occurs during a portion of the at least one of the initializing period, the data transmission period, and the vertical blank period.

3. The display driving IC of claim 2, wherein the power down mode in the data transmission period is activated in a portion of a horizontal blank period included in the data transmission period.

4. The display driving IC of claim 1, wherein the timing controller is configured to generate a standby control signal to activate the power down mode.

5. The display driving IC of claim 4, wherein the timing controller is further configured to generate the standby control signal based on at least one of an external signal and a status of an internal logic circuit.

6. The display driving IC of claim 4, wherein the timing controller is configured to transmit the standby control signal to each of the plurality of source drivers in a point-to-point manner or in a multi-drop manner.

7. The display driving IC of claim 4, wherein the timing controller is configured to transition from the power down mode to a normal mode when the activated standby control signal is deactivated.

8. A display driving integrated circuit (IC), comprising:

a plurality of source drivers; and a timing controller configured to output a plurality of signals to the plurality of source drivers, and at least one of the timing controller and the plurality of source drivers configured to operate in a power down mode in at least one of an initializing period, a data transmission period, and a vertical blank period, wherein the timing controller is configured to generate a standby control signal to activate the power down mode;

wherein the timing controller is configured to transition from the power down mode to a normal mode when the activated standby control signal is deactivated, wherein the timing controller includes a first clock signal generator and the timing controller is configured to adjust a bias current flowing through the clock signal generator to a normal value in the normal mode, and at least one of the plurality of source drivers includes a second clock signal generator and the at least one of the plurality of source drivers is configured to adjust a bias current flowing through the second clock signal generator to a normal value in the normal mode.

9. The display driving IC of claim 8, wherein the display driving IC is of a clock embedded type, the timing controller includes a clock signal generator and is configured to output a training pattern in the normal mode, and the plurality of source drivers are configured, in the normal mode, to determine a point at which the clock signal generator starts clock training according to the training patterns, wherein the point is determined as a starting point of the normal mode.

10. An image data processing system, comprising:

a display panel configured to reproduce an image signal;

a plurality of source drivers configured to drive the display panel; and a timing controller configured to control an operation of the plurality of source drivers, at least one of the timing controller and the plurality of source drivers operating in a power down mode wherein power consumption is reduced in at least one of an initializing period, a data transmission period, and a vertical blank period, and wherein in the power down mode, the timing controller is configured to output at least one of a constant DC voltage and a high impedance setting signal to the plurality of source drivers, an internal circuit of the timing controller is configured such that a bias current flowing through a clock signal generator included in the timing controller is reduced, an internal circuit of the plurality of source drivers is configured such that an internal bias current of the internal circuit is reduced, and the plurality of source drivers are configured to have their internal on die termination (ODT) resistance values modified.

11. The display driving IC of claim 8, wherein the timing controller is further configured to generate the standby control signal based on at least one of an external signal and a status of an internal logic circuit.

12. The display driving IC of claim 8, wherein the timing controller is configured to transmit the standby signal to each of the plurality of source drivers in a point-to-point manner or in a multi-drop manner.

13. The display driving IC of claim 8, wherein the timing controller is configured to transmit a data packet including a plurality of fields to the source drivers in the data transmission period, and wherein at least one of the plurality of fields includes the standby control signal.

14. The display driving IC of claim 1, wherein the timing controller is configured to transmit a data packet including a plurality of fields to the source drivers in the data transmission period, and wherein at least one of the plurality of fields includes the standby control signal.

* * * * *